United States Patent [19]

Wren

[11] Patent Number: 5,061,530

[45] Date of Patent: Oct. 29, 1991

[54] COMBINED HORIZONTAL AND VERTICAL MANUFACTURING METHOD AND FACILITY FOR COATING VEHICLE STRUCTURAL COMPONENTS

[75] Inventor: Michael K. Wren, Milwaukee, Wis.

[73] Assignee: A. O. Smith Corporation, Milwaukee, Wis.

[21] Appl. No.: 474,159

[22] Filed: Feb. 2, 1990

[51] Int. Cl.[5] ..... B05D 1/18

[52] U.S. Cl. ..... 427/430.1; 427/346; 118/423; 118/426; 118/428; 118/429

[58] Field of Search ..... 118/423, 425, 426, 429, 118/428, 500; 427/346, 430.1, 443

[56] References Cited

U.S. PATENT DOCUMENTS

| | | | |
|---|---|---|---|
| 2,073,576 | 3/1937 | Climenhaga | 118/423 X |
| 2,116,430 | 5/1938 | Gordon | 118/423 |
| 2,552,612 | 5/1951 | Adams et al. | 118/423 X |
| 2,570,746 | 10/1951 | Babuk | 118/423 X |
| 2,658,008 | 11/1953 | Williams et al. | 118/423 |
| 2,728,686 | 12/1955 | Borushko | 118/423 X |
| 2,852,410 | 9/1958 | Brewer | 118/500 X |
| 2,862,236 | 12/1958 | Shapero | 118/423 X |
| 2,944,655 | 7/1960 | Griswold | 198/409 |
| 3,183,818 | 5/1965 | Pangborn et al. | 118/423 X |
| 3,472,203 | 10/1969 | Coleman | 118/425 |
| 4,407,225 | 10/1983 | Kataishi et al. | 118/425 |
| 4,408,560 | 10/1983 | Caratsch | 118/425 X |
| 4,473,604 | 9/1984 | Rolle et al. | 118/423 |
| 4,502,410 | 3/1985 | Donahue | 118/429 |
| 4,560,592 | 12/1985 | Friedland | 118/425 X |
| 4,834,019 | 5/1989 | Gorden et al. | 118/423 |

FOREIGN PATENT DOCUMENTS

| | | | |
|---|---|---|---|
| 0018925 | 1/1985 | Japan | 118/423 |

*Primary Examiner*—Shrive Beck
*Assistant Examiner*—Alain Bashore
*Attorney, Agent, or Firm*—Andrus, Sceales, Starke & Sawall

[57] ABSTRACT

A manufacturing method and facility (200) transports vehicle structural components, such as frames (202), in a horizontal position through a coating station (214). The orientation of the frames is changed to a vertical position, and the frames are transported in the vertical position through a drip station (220).

5 Claims, 11 Drawing Sheets

FIG. 20

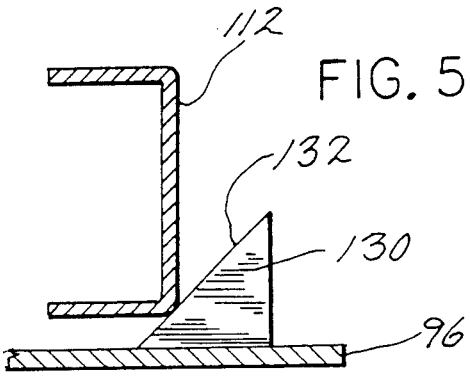
FIG. 5
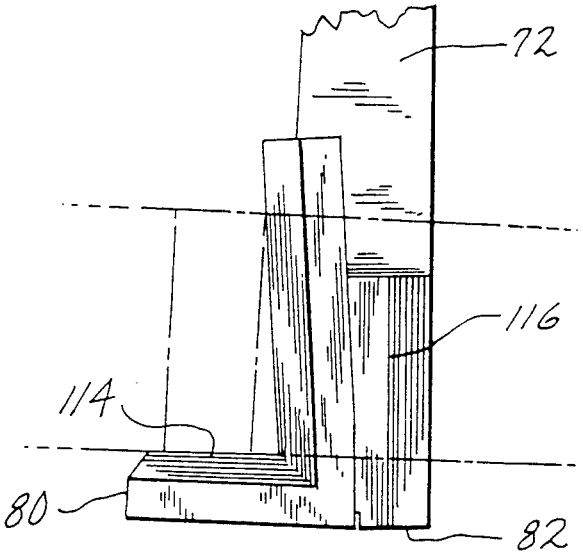
FIG. 6
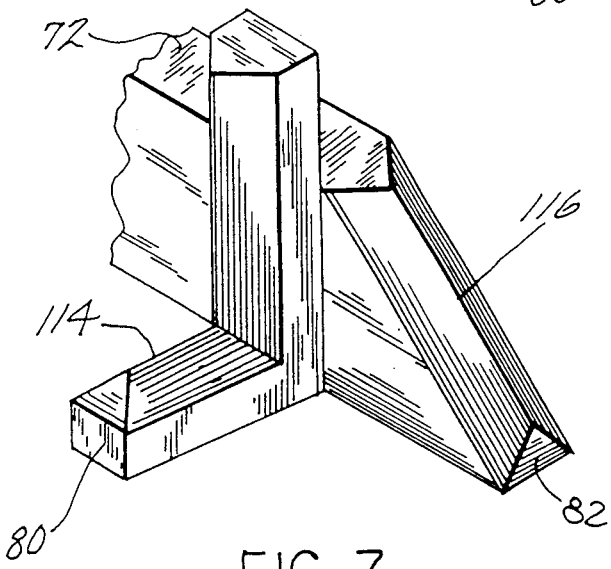
FIG. 7
FIG. 12
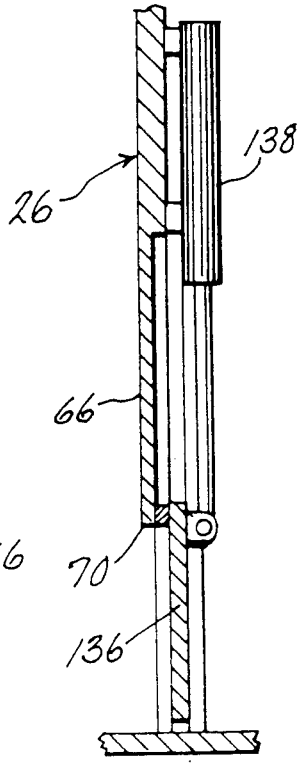
FIG. 11
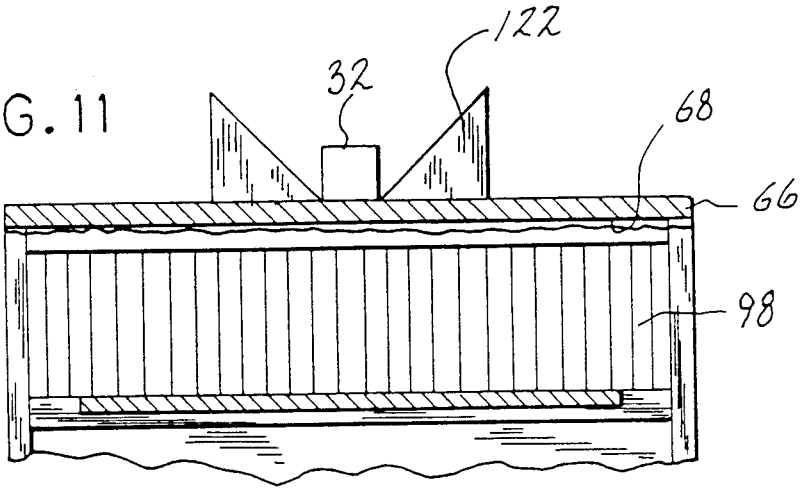

FIG. 8
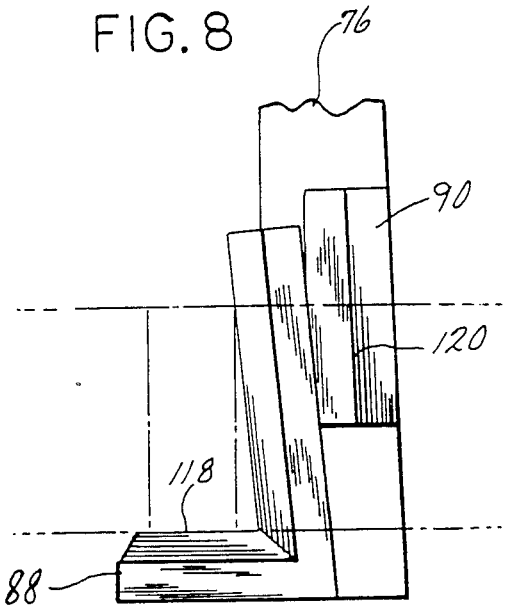
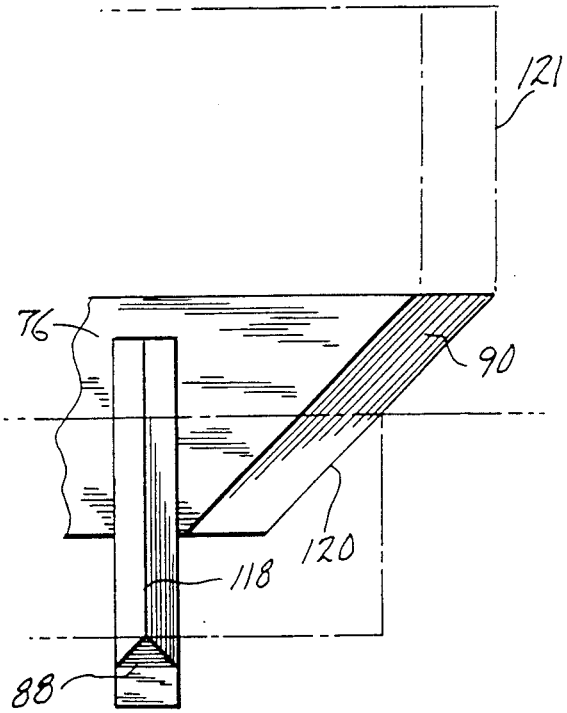
FIG. 9
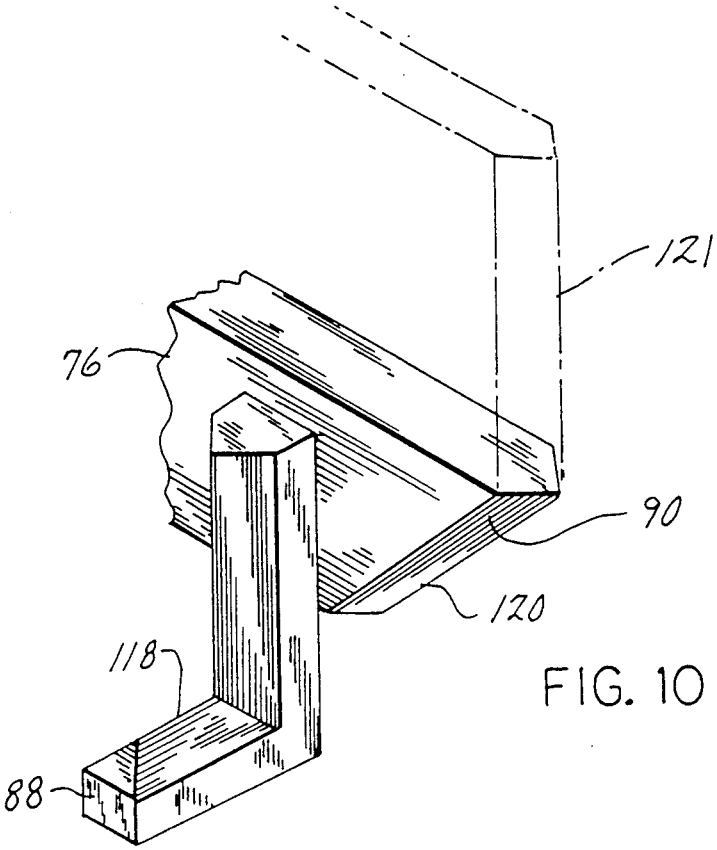
FIG. 10

COMBINED HORIZONTAL AND VERTICAL MANUFACTURING METHOD AND FACILITY FOR COATING VEHICLE STRUCTURAL COMPONENTS

BACKGROUND AND SUMMARY

The present invention arose during continuing development efforts relating to commonly owned copending application Ser. No. 07/389,346, filed Aug. 3, 1989.

The present invention relates to continuing development efforts directed toward manufacturing methods and facilities for applying a coating to vehicle structural components, including the application of a hot melt wax coating to vehicle frames for protection against rust and corrosion.

The invention of the noted copending application arose during development efforts directed toward reducing the high capital expense of a manufacturing facility for coating vehicle structural components such as frames. Vehicle manufacturers are more commonly requiring vendors and parts suppliers to have local on-site manufacturing or processing facilities coordinating with the assembly operation of the vehicle manufacturer. In the case of suppliers providing vehicle structural components such as frames, this requires erection of a coating facility at each of the various satellite assembly facilities. However, erection of multiple satellite coating facilities is not cost effective due to the extremely high capital expense of same.

A vehicle frame is a generally flat longitudinal structural member which in one exemplary size has a longitudinal length of about 178 inches, a lateral width of about 42 inches, and a height of about 16 inches, though the dimensions may of course vary. Prior facilities for applying a hot melt wax coating to such frames typically require buildings of about 2 million cubic feet, with 50,000 square feet of lateral area and over 60 feet in height. The frames are hung vertically and transported to a dipping tank and dipped downwardly into the tank for coating the frame in the hot melt wax liquid, and then raised out of the tank. Hence, the building must be at least twice as high as the longitudinal length of the frame. The tank volume is about 63,000 gallons. The building is heated by ovens or the like such that the heated air in the building preheats the frames prior to dipping, to enhance the coating during the dip into the hot melt wax liquid tank. Preheating of the frames with air is inefficient and requires long preheat times. The vertical hanging of the frames also requires large openings into and out of the building, causing significant heat loss and energy inefficiency. The construction cost of the building is high because of its special requirements. Furthermore, the building has no other use.

The invention of the copending application addresses and solves the above noted problems with a simple and effective manufacturing method and facility. The invention of the copending application reduces the building volume by a factor of 10 or more, e.g. the new building can be reduced to as little as 5% of the volume of the prior building. The invention of the copending application also reduces the tank volume requirements for the coating liquid to as little as 4%, e.g. to as low as 2,000 gallons instead of the 63,000 gallons required for the above noted prior tank. This saves wax cost. The invention of the copending application also significantly reduces the height requirement of the tank, e.g. from about 25 feet deep to about 25 inches deep. This desirably solves problems of hydrostatic fluid pressure and leakage caused thereby at the bottom of the tank. The construction cost of the building is reduced by a factor of about 10 due to the reduced special requirements of the building and also due to reduced loading capability of the building due to special transport structure within the building in accordance with the invention for carrying the vehicle structural components. The building is adaptable to other uses in the event of changing requirements. The transport mechanism and core within the building can be moved to other buildings and locations.

The present invention provides a manufacturing method and facility with substantially reduced space requirements. The present invention provides combined horizontal and vertical processing of the frames. In one embodiment, the frames enter the facility horizontally and are dipped into an elongated coating tank and moved longitudinally therethrough. The frames are then removed from the tank, and one end of the frame is released such that it swings downwardly and the frame hangs vertically in a postheat drip station such that the hot wax drips down the vertically hung frame.

BRIEF DESCRIPTION OF THE DRAWINGS

Copending Application

FIG. 5 is a sectional view taken along line 5—5 of FIG. 4.

FIG. 6 is an enlarged view of a portion of the structure in FIG. 4.

FIG. 7 is a perspective view of the structure of FIG. 6.

FIG. 8 is an enlarged view of a portion of the structure in FIG. 4.

FIG. 9 is an end view of the structure in FIG. 8.

FIG. 10 is a perspective view of the structure in FIG. 8.

FIG. 11 is a sectional view taken along line 11—11 of FIG. 4.

FIG. 12 is a sectional view taken along line 12—12 of FIG. 1.

Present Invention

Figures 20, 21, 22:
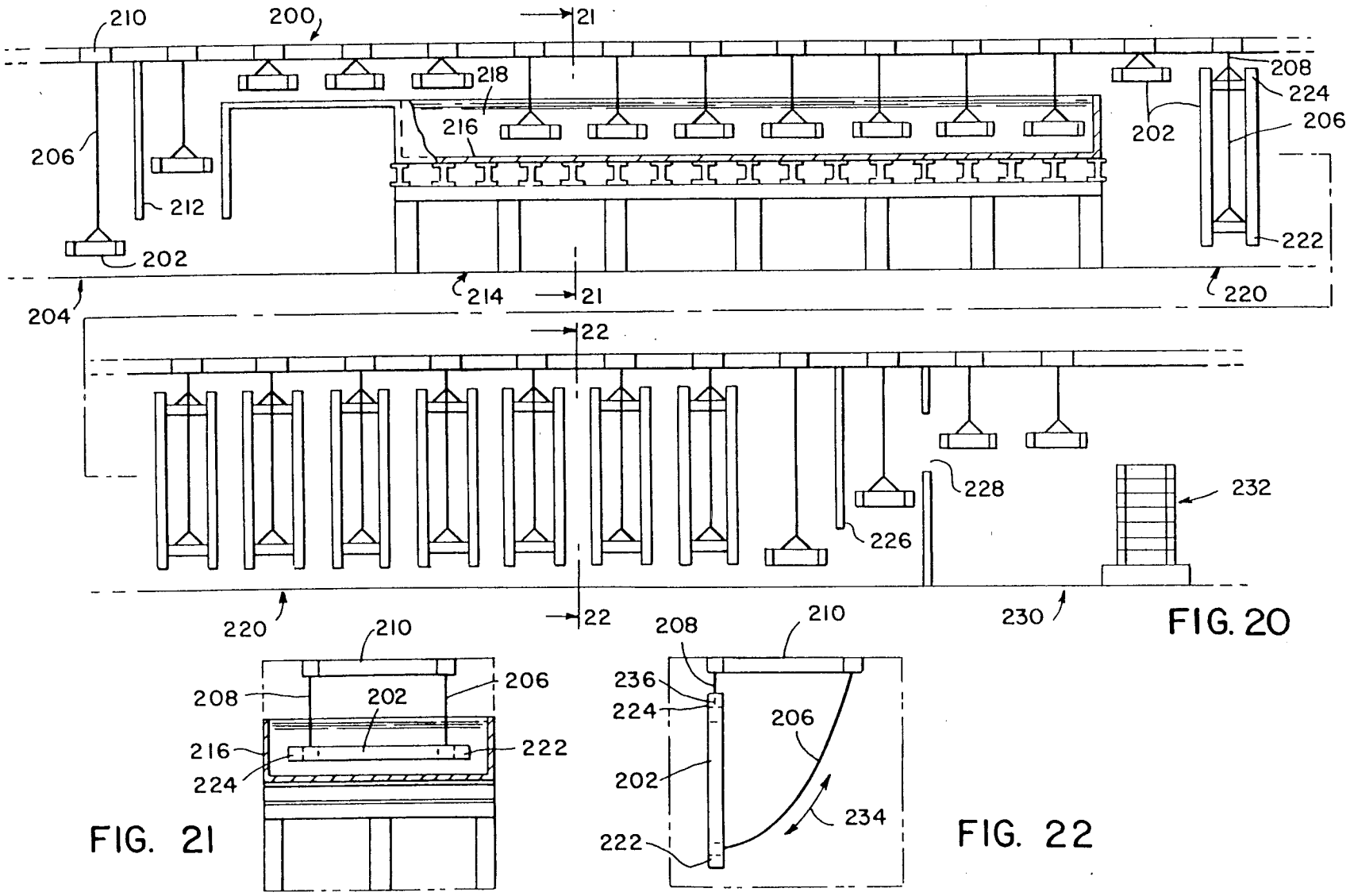

FIG. 20 is a side view of a manufacturing facility constructed in accordance with the present invention.

FIG. 21 is a view taken along line 21—21 of FIG. 20.

FIG. 22 is a view taken along line 22—22 of FIG. 20.

Figure 23:
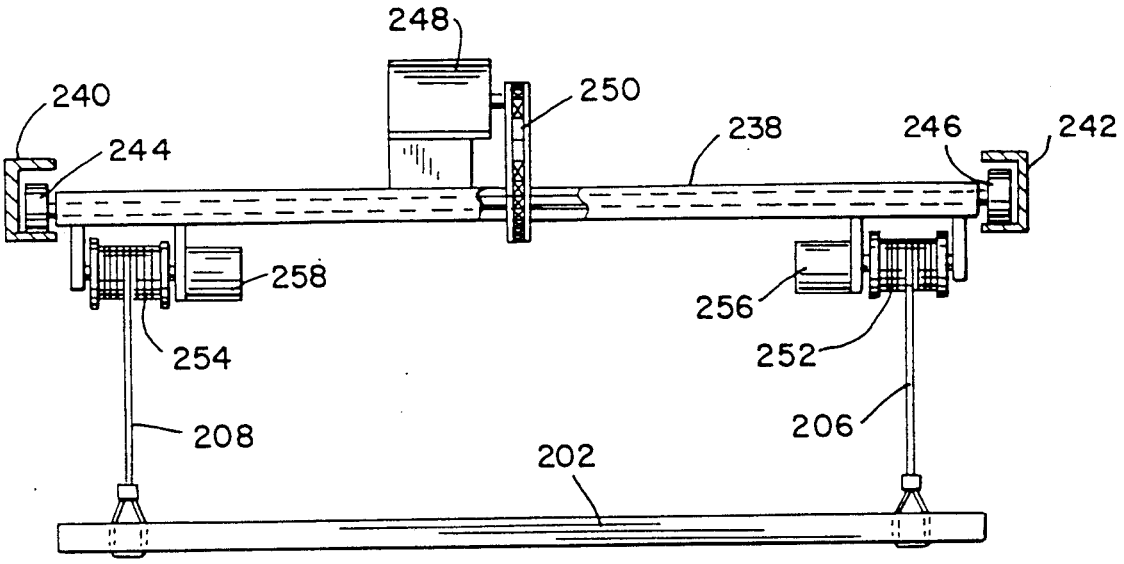

FIG. 23 is an end view of a portion of the structure in FIG. 20.

DETAILED DESCRIPTION

Copending Application

Figure 1:
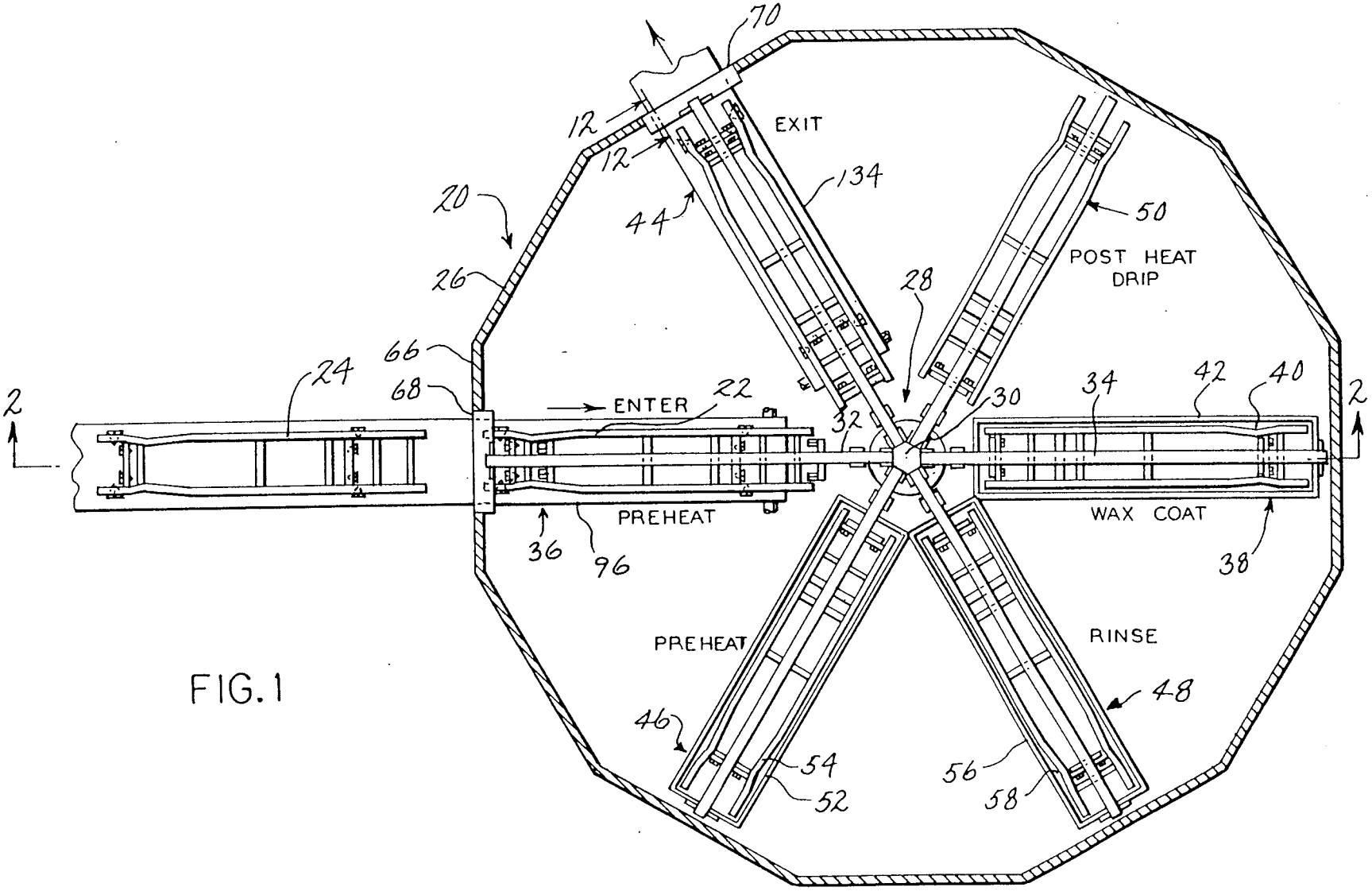
FIG. 1 is a top view of a manufacturing facility constructed in accordance with the invention of the copending application.

FIG. 1 shows a manufacturing facility 20 with substantially reduced space requirements for applying a coating to vehicle structural components such as frames 22, 24, and the like. The facility includes a building 26 housing a central rotary carousel 28 having a central hub 30 rotatable about a vertical axis and having a plurality of arms 32, 34, etc. thereon. Building 26 also houses a loading station 36, a coating station 38 having coating liquid 40 in tank 42, and an unloading station 44, all spaced peripherally around hub 30 such that rotation of hub 30 moves the arms to the various stations. Building 26 also houses a preheat wash station 46, a rinse station 48, and a post heat drip station 50. Preheat wash station 46 includes a tank 52 with a wash liquid 54 at an elevated temperature. Rinse station 48 includes a tank 56 with a rinse liquid 58 at an elevated temperature. The preheat wash and rinse stations preheat the frame by liquid heat transfer, to enhance the hot melt wax coating at station 38 when the frame is dipped into the hot melt wax coating liquid 40, to be described.

Counterclockwise rotation of hub 30 moves arm 32 to loading station 36 as shown in FIG. 1, for attaching frame 22 to arm 32, to be described. Further counterclockwise rotation of hub 30 moves arm 32 to preheat wash station 46, and then to rinse station 48, and then to coating station 38, and then to post heat drip station 50, and then to unloading station 44 for detaching frame 44 from the arm.

Figure 2:
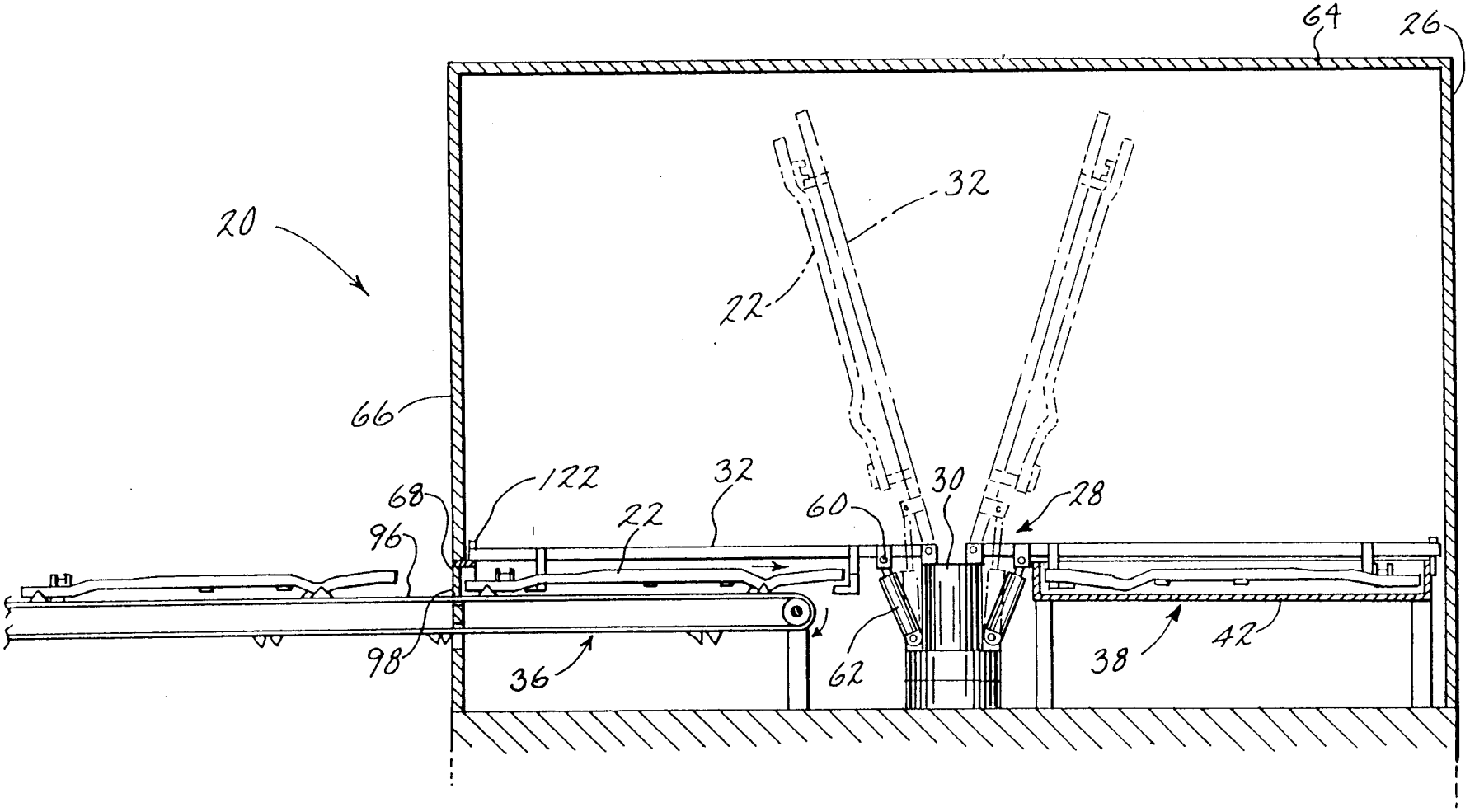
FIG. 2 is a sectional view taken along line 2—2 of FIG. 1.

Arm 32 moves downwardly, FIG. 2, at loading station 36 to engage frame 22 and then moves upwardly to lift the frame and carry the frame during rotation of hub 30. The arm moves downwardly at each of stations 46, 48 and 38 to lower the frame into the liquid in the respective tank, and then moves upwardly to raise the frame out of such liquid in the respective tank. The arm moves downwardly at unloading station 44 to disengage the frame and then moves upwardly and rotates to loading station 36, to begin the next cycle.

Arm 32 swings in an arc about pivot point 60 at hub 30, and is actuated between its upwardly raised position as shown in phantom line and its downwardly lowered position as shown in solid line by a hydraulic cylinder 62, or alternatively is pneumatically actuated, or is raised and lowered by a cable, chain, or the like. Frame 22 at loading station 36 is attached in a generally horizontal position to arm 32. The frame is likewise detached in a generally horizontal position from the arm at unloading station 44. The frame is lowered by the arm into the respective tanks at stations 46, 48 and 38 in a generally horizontal position in the respective tank. The horizontal loading, dipped and unloading positions of the frame are all substantially coplanar.

Frame 22 has a longitudinal extent of a given length. As seen in FIG. 2, building 26 has a height to roof 64 substantially less than twice the length of frame 22. The transport mechanism provided by carousel 28 moves frame 22 through stations 36, 46, 48, 38 and 44 such that the longitudinal extent of frame 22 is substantially horizontal. The raising and lowering of frame 22 into and out of the tanks at stations 46, 48 and 38 defines a travel path having a vertical height substantially less than twice the length of the frame. Building 26 has a sidewall 66 with an entrance opening 68 therethrough, FIGS. 1, 2 and 11, at loading station 36, and an exit opening 70 therethrough at unloading station 44. Frame 22 is passed longitudinally through such openings in a generally horizontal position into and out of building 26, such that openings 68 and 70 have minimum dimensions, to minimize heat loss from the building.

At drip station 50, uncoated excess liquid is allowed to drip from the frame. Additionally or alternatively, uncoated excess liquid is allowed to drip from the frame above tank 42 at coating station 38. The amount of pivoting of the transport arm varies the tilt angle, to provide an adjustable drip angle of the frame. This is particularly desirable because it enables a selectively chosen drip angle, which in some instances may be vertical, or in other instances at a diagonal angle relative to horizontal. The latter is preferred to prevent drips from one of the lateral cross pieces of the frame from dripping onto another lateral cross piece therebelow. The pivoted transport arm thus moves the frame through the coating station into and out of contact with the coating liquid and raises the frame after such coating to a tilted position such that the longitudinal extent of the frame is tilted at an angle relative to horizontal.

Figure 3:
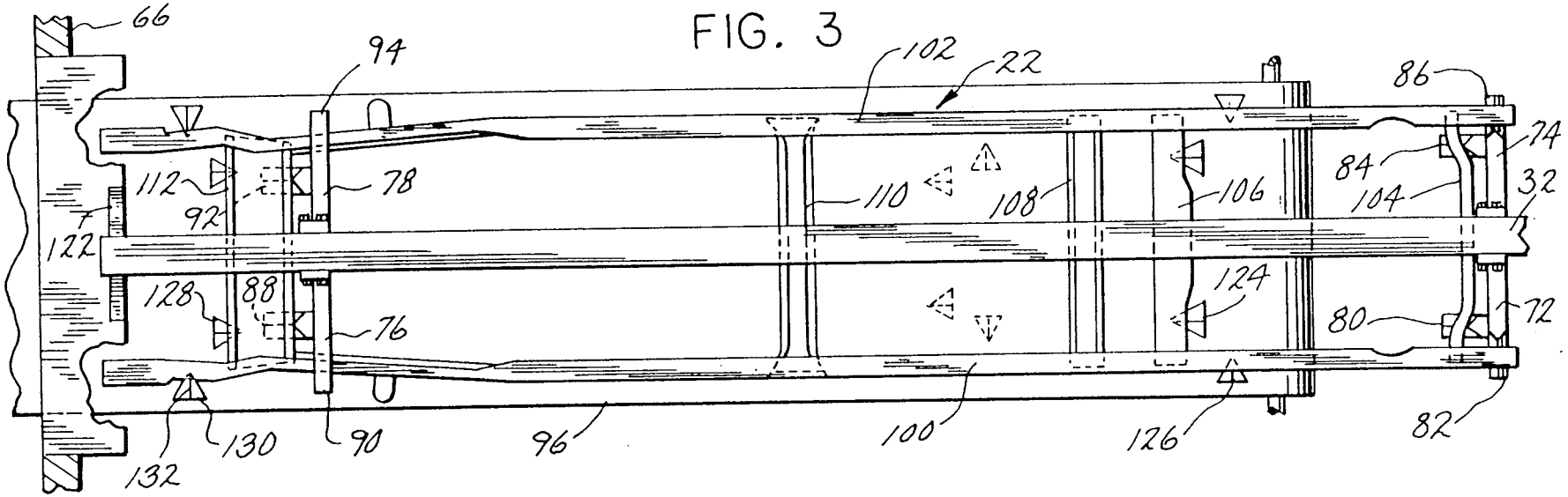
FIG. 3 is an enlarged top view of a portion of the structure in FIG. 1.
Figure 4:
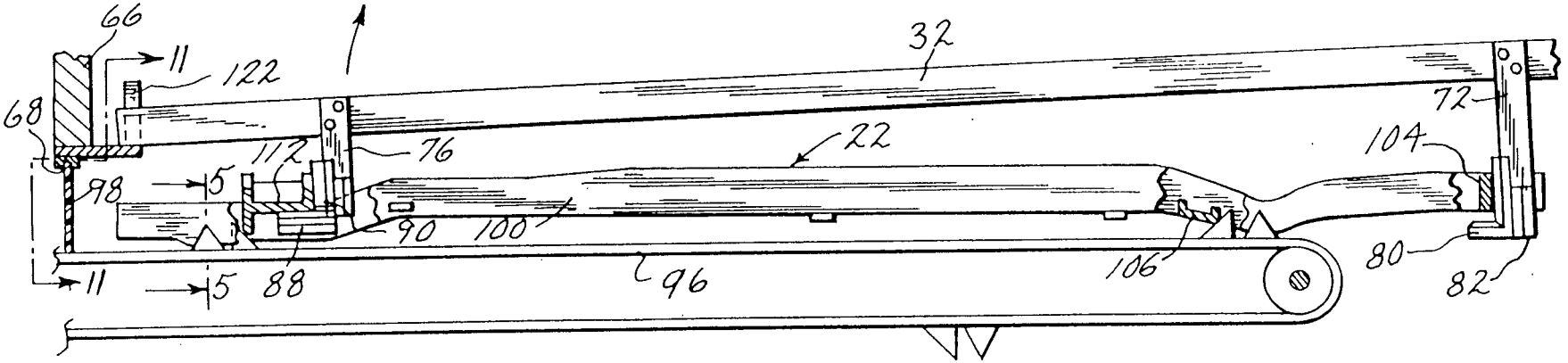
FIG. 4 is a side view of the structure in FIG. 3.

Hands 72, 74, 76, 78, FIGS. 3 and 4, extend from arm 32 and have fingers 80, 82, 84, 86, 88, 90, 92, 94 engaging frame 22. Frame 22 is attached to the fingers at loading station 36. A conveyance mechanism provided by continuous belt conveyor 96 carries frame 22 longitudinally horizontally through flexible hanging leaves 98 at opening 68 in building wall 66 to loading station 36. Conveyor 96 carries frame 22 rightwardly, FIGS. 1–4, to a first position. Arm 32 is swung downwardly, with at least some of the noted fingers moving downwardly past and below frame 22. Conveyor 96 then carries frame 22 further rightwardly, advancing frame 22 to a second position above the last mentioned fingers, such that upon swinging arm 32 upwardly, such last mentioned fingers engage the underside of frame 22 and lift same.

Frame 22 is a generally flat planar member having a pair of longitudinal sides 100 and 102, FIG. 3, and a plurality of lateral cross pieces such as 104, 106, 108, 110, 112. Fingers 80 and 84 engage the underside of cross piece 104. Fingers 82 and 86 engage the underside of longitudinal sides 100 and 102, respectively. Fingers 88 and 92 engage the underside of cross piece 112. Fingers 90 and 94 engage the top side of longitudinal sides 100 and 102, respectively. The noted engagement locates the longitudinal sides of the frame and the respective cross pieces of the frame, to precisely locate the frame both longitudinally and laterally.

The fingers are formed with a knife edge laterally crossing the respective portion of the frame, for example as shown at knife edges 114 and 116 for respective fingers 80 and 82 in FIGS. 6 and 7, and knife edges 118 and 120 for respective fingers 88 and 90 in FIGS. 8–10. The lower fingers 80, 84, 88, 92 are slightly angled, such that when arm 32 is in the lowered position, the lower fingers tilt upwardly leftwardly and engage only an edge of the frame to provide only point contact therewith, to enhance the coating of the frame. The lateral lower fingers 82 and 86 and the lateral upper fingers 90 and 94 extend laterally across the longitudinal sides of the frame and are likewise angled, as shown in FIGS. 7 for finger 82, and in FIGS. 9 and 10 for finger 90, to also provide only point contact with the frame, to enhance coating of the frame. The noted lower longitudinal fingers are tilted sufficiently relative to the respective hands such that arm 32 may be lowered to a position slightly beyond horizontal, FIG. 4, and the lower fingers will still engage and lift frame 22. In a further embodiment, finger 90 has an upwardly extending portion 121 facilitating stacking of frames. In this latter embodiment, two or more frames are carried on carousel arm 32, such that two or more frames are dipped during each dipping step, etc. In this embodiment, edge 120 does not engage the top of the frame therebelow, but rather locates the siderails of the frame outboard thereof, and edge 121 is spaced slightly inwardly of the frame siderail.

Stationary V-shaped structure 122, FIG. 11, is provided at loading station 36 and spaced above conveyor 96 and is engaged by arm 32 during downward swinging of the arm to guide and locate the arm relative to conveyor 96 and frame 22. Conveyor 96 has a plurality of cones 124, 126, 128, 130, etc., thereon, with angled bevel surfaces forming knife edges such as 132, FIGS. 3 and 5, which extend along a diagonal angle to provide point contact with the frame. Some of the cones such as cones 126 and 130 engage the longitudinal sides of the frame, and others of the cones such as cones 124 and 128 engage lateral cross pieces of the frame. The cones space the frame above conveyor 96 and precisely locate the frame both longitudinally and laterally. In an alternate embodiment, the frame has a plurality of holes in the underside thereof, and conveyor 96 has a plurality of cones extending upwardly partially through such holes and spacing the frame above the conveyor and precisely locating the frame both longitudinally and laterally.

Unloading at station 44 is comparable but reversed in sequence from loading at station 36. A conveyor 134 is provided like conveyor 96. The transport arm of the carousel is lowered to lower the frame onto the cones on the conveyor. The above noted knife edges and angles on the fingers provide the noted point contact with the frame and minimize marring of the coating on the frame. In most applications, there is no marring because the hot melt wax coating heals itself, which healing is facilitated by the noted point contact, which minimizes the area which must be healed by continued flow of the hot melt wax coating after disengagement of the frame by the fingers. The above noted beveled surfaces and knife edges such as 132, FIG. 5, of the cones on the conveyor and the angles thereof desirably provide only point contact with the coated frame on exit conveyor 134. After the pivot arm of the carousel is lowered such that the frame now rests on the cones on conveyor 134, the latter moves slightly to partially advance the frame to allow clearance of the lower fingers, and the pivot arm is then raised upwardly, whereafter conveyor 134 carries the frame outwardly through opening 70 of the building. Opening 70 is not provided with the hanging flexible leaves such as 98 of entrance opening 68, because such leaves would drag across and mar the coating on the frame. Instead, opening 70 is provided with a quick acting guillotine door 136, FIG. 12, actuated by pneumatic cylinder 138 to quickly move vertically upwardly and downwardly. This minimizes heat loss from the building.

Figure 13:
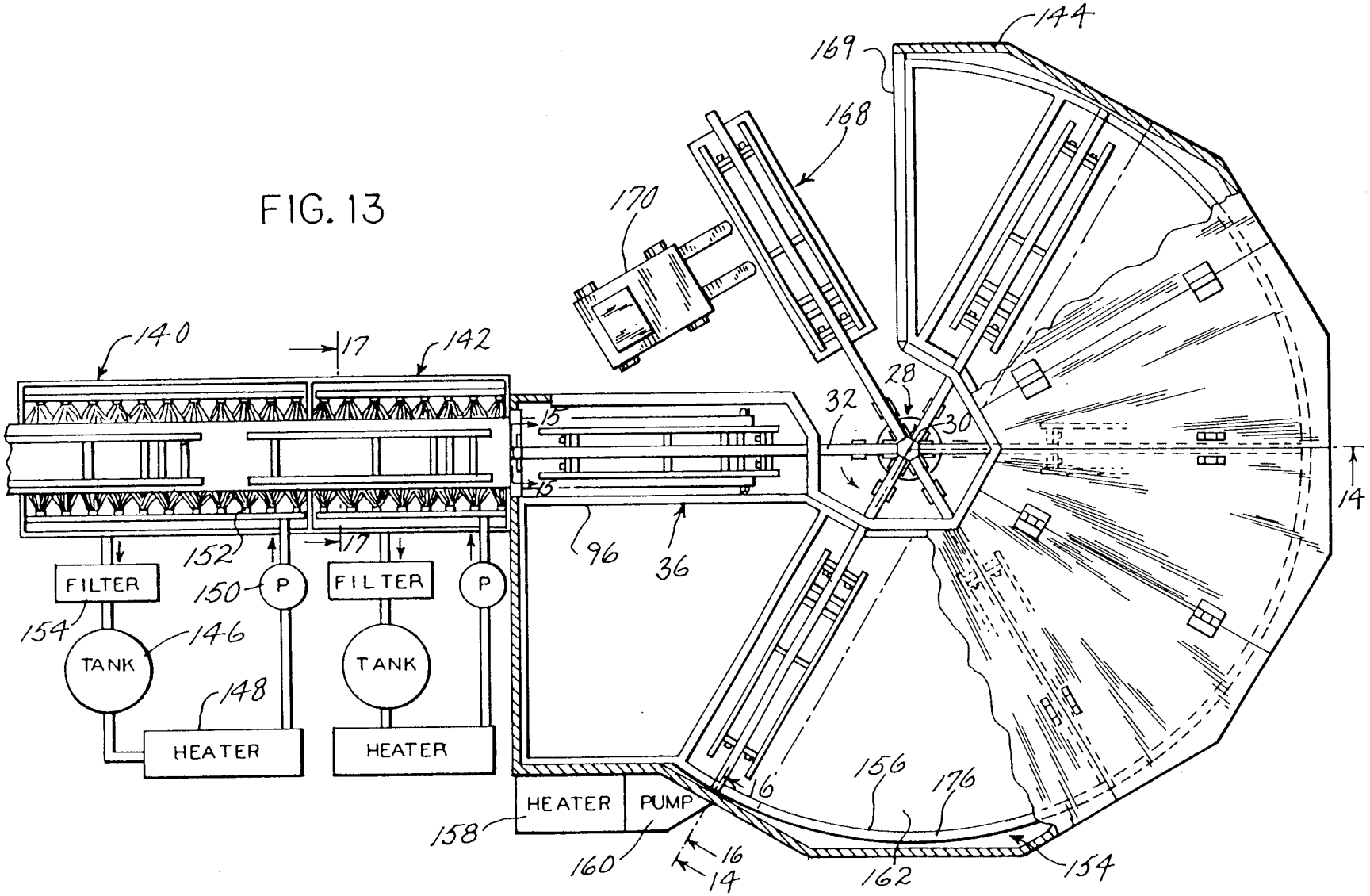
FIG. 13 is a top view of an alternate embodiment of a manufacturing facility constructed in accordance with the invention of the copending application.
Figure 16:
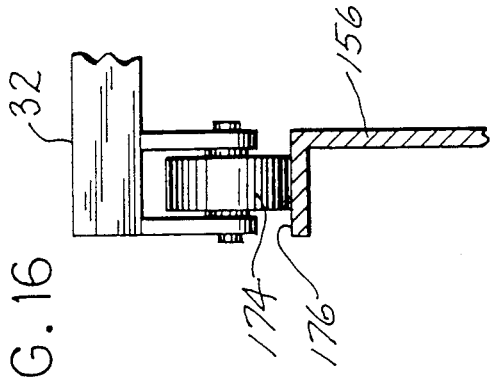
FIG. 16 is a sectional view taken along line 16—16 of FIG. 13.

FIG. 13 shows a further embodiment, and like reference numerals are used from the above FIGS. where appropriate to facilitate clarity. Preheat wash and rinse stations 140 and 142 are external of building 144. Preheat wash station 140 includes a tank 146, a heater 148, a pump 150 supplying heated wash liquid to spray nozzles 152, and a return filter 154. Rinse station 142 is comparable for rinse liquid. Conveyor 96 conveys the frame horizontally longitudinally through stations 140 and 142 to provide liquid heat transfer to the frame, and then moves the frame into building 144. This movement is along the direction of the longitudinal extent of the frame. The frame is attached to pivot arm 32 as above described, and the arm swings upwardly to lift the frame from conveyor 96.

Coating station 38 of FIG. 1 is replaced by a coating station 154 in FIG. 13 with a tank 156 which is substantially laterally expanded to extend along a significant portion of the inner periphery of the building around hub 30. In FIG. 13, tank 156 has a semicircular shape when viewed from above. Transport arm 32 lowers the frame into and out of tank 156, as above. Transport arm 32 also moves the frame horizontally through tank 156 in a direction transverse to the longitudinal extent of the frame. The lowering and raising of the frame into and out of the tank defines a travel path having a vertical height substantially less than twice the length of the frame, as before. A heater 158 and pump 160 are provided for heating and pumping coating liquid 162 to tank 156.

Figure 14:
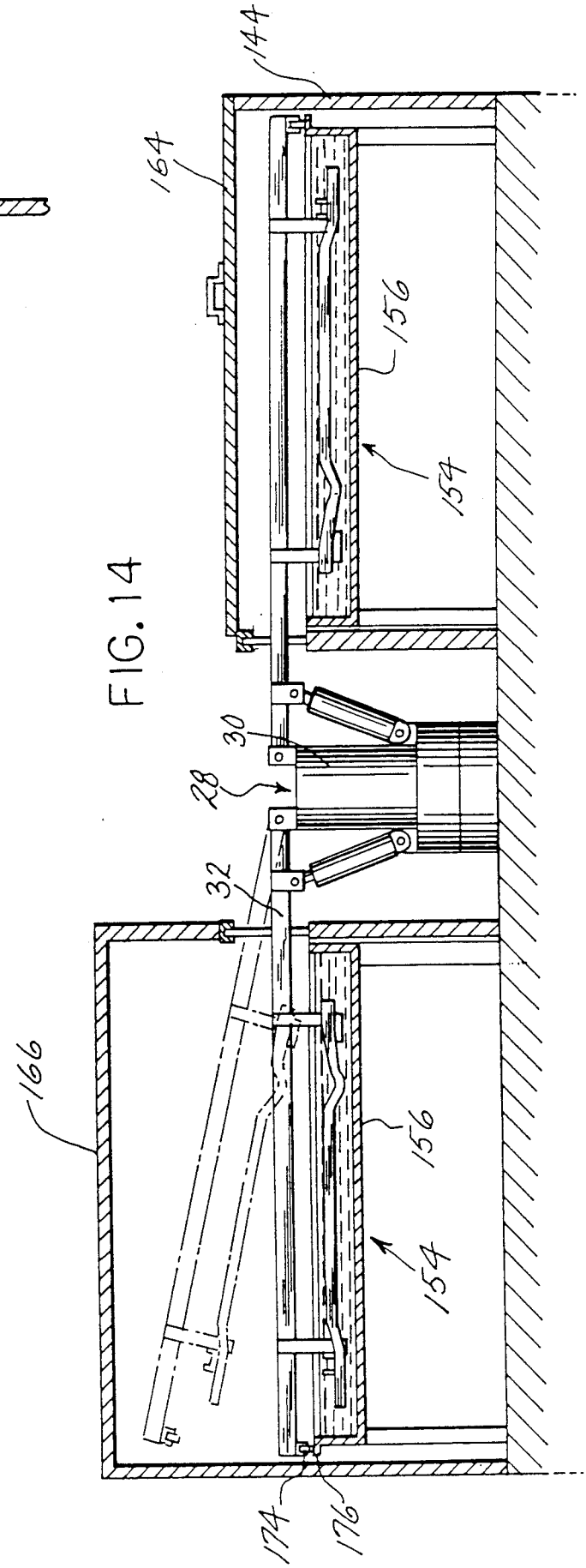
FIG. 14 is a sectional view taken along line 14—14 of FIG. 13.

Building 144 has differing heights at loading station 36 and the central portion of coating station 154. At loading station 136, the building must be high enough to allow arm 32 to pivot upwardly to lift the frame from conveyor 96. However, in the central portion of coating station 154, as shown on the right side of FIG. 14, arm 32 need only move horizontally laterally, and hence there is no need for any greater building height other than a small clearance for arm 32 above the tank. The roof of building 144 along this central portion of coating station 154 is provided by access doors 164. At the beginning of coating station 154, an increased building height is necessary as shown at roof 166 at the left side of FIG. 14, to accommodate movement of arm 32 in an upward position over tank 156 and then downward movement of arm 32 to lower the frame into tank 156. The building likewise has a higher roof at the end of coating section 154. The building thus has a first lower height at roof access door 164 over the middle of tank 156, and second higher heights as at roof 166 at the ends of the tank to permit downward and upward swinging of arm 32 to lower and raise the frame into and out of the tank. The unloading station may be provided within the building, as in FIG. 1, or an external loading station 168 may be provided with the frames remaining in a horizontal position but stacked vertically, and then periodically removed by a forklift 170 or the like. Building 144 has an external recess 169 formed in the periphery thereof at which unloading station 168 is located.

Figure 15:
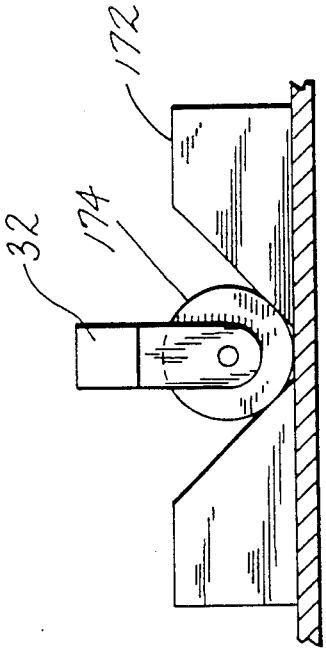
FIG. 15 is a sectional view taken along line 15—15 of FIG. 13.

In a further embodiment, a cam track is provided in the building to assist or eliminate the pivot arm actuators such as 62. FIG. 15 shows a cam track 172 extending at least partially peripherally around central hub 30. Arm 32 has a roller 174 engaging and rolling along the cam track during rotation of hub 30 such that arm 32 is lowered and raised according to the camming profile of the cam track. The cam track has a V-shape at loading station 136 such that roller 174 rides down the V to lower the arm to engage the frame. At coating station 154, the cam track may be provided by the upper lip 176 of the tank having high lobes at the beginning and the end of the tank, and having an extended low lobe along the central portion of the tank. The horizontal circumferential length of the low lobe portion of the cam surface controls the length of horizontal travel of the frame in coating liquid 162 in tank 156 during rotation of hub 30, to control coating of the frame.

Figure 18:
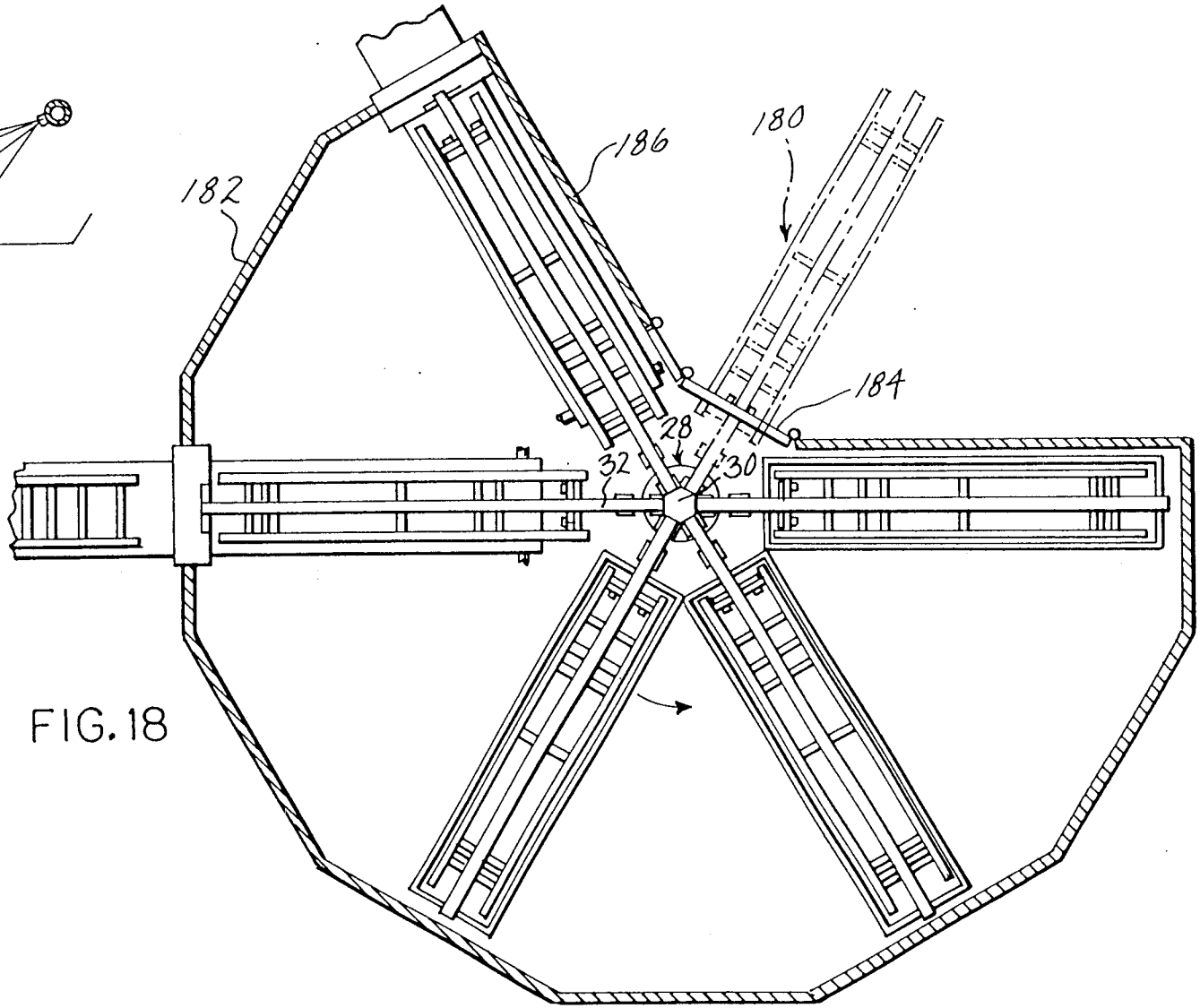
FIG. 18 is a top view of another embodiment of a manufacturing facility constructed in accordance with the invention of the copending application.
Figure 17:
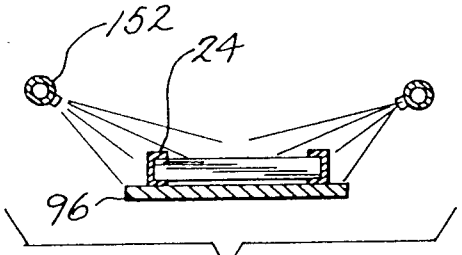
FIG. 17 is a sectional view taken along line 17—17 of FIG. 13.

FIG. 18 shows another embodiment, and uses like reference numerals from the above FIGS. where appropriate to facilitate clarity. A servicing station 180 is spaced along the periphery of hub 30. Building 182 has an opening 184 at station 180. The carousel pivot arm is movable to a lowered position at servicing station 180, passing through opening 184 in building 182 externally of the building to external servicing location 180 for servicing of the transport pivot arm. The arm is movable to an upward position at servicing station 180 remaining within building 182 and bypassing external servicing location 180 and instead passing within building 182 to the next station therein upon rotation of hub 30. Building 182 has an external recess 186 formed therein at servicing station 180 providing the external location for servicing of the pivot arm. Thus, when servicing is desired, the pivot arm is swung downwardly through opening 184 to permit servicing, and then pivoted back upwardly through opening 184 when the servicing is completed. This allows servicing of the pivot arm externally of the building, which is desirable because the servicing technican can remain outside the building and not have to work in the elevated temperatures within the building. When servicing is not desired, the pivot arm merely remains in its upward pivoted position at station 180 without passing through opening 184.

Figure 19:
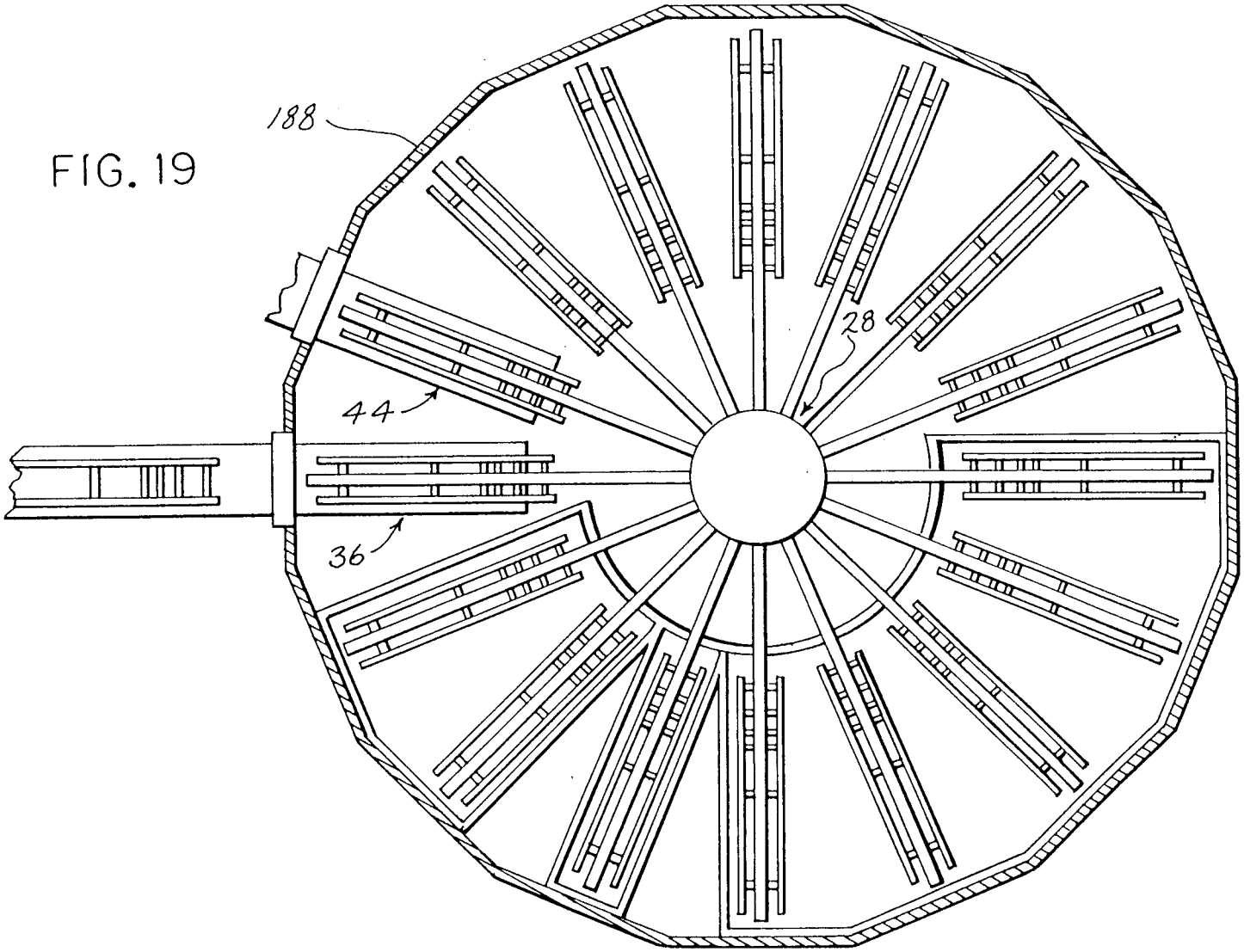
FIG. 19 is a top view of another embodiment of a manufacturing facility constructed in accordance with the invention of the copending application.

FIG. 19 shows another embodiment, and like reference numerals are used from the above FIGS. where appropriate to facilitate clarity. Building 188 has an increased number of stations which may provide various desired combinations of preheat washing, rinsing, coating, and dripping between loading station 36 and unloading station 44. The carousel at the core of the building is supported independently of the building, and may be moved to different locations and buildings as desired.

Numerous alternatives are possible For example, instead of conveying the frames to the loading station with a conveyor, other conveyance mechanisms may be used, such as a cart, a shuttle, loading from beneath rather than through a sidewall opening, etc. While plural transport pivot arm assemblies are shown, single arm assemblies may of course be used. A facility with a single station in the building may also be used, to provide only coating within the building, and to provide loading and unloading externally of the building, as well as preheating if desired. The facilities and methods disclosed may also be used in cold coating processes. In further embodiments, the motor drive for the hub may be provided at the hub within the building, or may be provided externally of the building with an outer ring for mechanical advantage enabling a smaller motor and saving the motor from the harsh environment and elevated temperatures within the building. While a single frame per pivot arm of the carousel is shown, each arm may carry and dip more than one frame at a time. For example, one frame may be carried above the arm, and another frame below the arm. Further alternatively, multiple frames may be stacked, and carried by an arm.

Present Invention

FIG. 20 shows a manufacturing facility 200 for applying a coating to vehicle structural components such as frames 202. The facility has a loading station 204 at which frame 202 is attached in a generally horizontal position to a pair of cables 206 and 208, FIG. 21, hanging from a conveyor 210 providing a transport mechanism. The frame is transported horizontally beneath a barrier wall 212 retaining heat in the facility, and is then raised upwardly and transported horizontally to coating station 214 provided by a tank 216 containing coating liquid 218. The frame is transported in a generally horizontal position through tank 216 transversely to the longitudinal extent of the frame.

At the end of the coating station, the frame is raised upwardly and then transported horizontally to a post-heat drip station 220. In the drip station, the orientation of frame 202 is changed to a generally vertical position, and the frame is transported in the vertical position through drip station 220. The orientation of frame 202 is changed by releasing one longitudinal end 222 of the frame by providing slack in cable 206 such that frame end 222 swings downwardly to a position generally vertically below the other longitudinal end 224 of the frame. In the vertical position, the frame is supported solely by cable 208. Cable 206 remains attached to frame end 222, and at the end of drip station 220, cable 206 is tensioned and retracted upwardly, to pull frame end 222 upwardly such that the orientation of the frame is again changed to a generally horizontal position, with the frame supported by both cables 206 and 208. The frame then passes horizontally below barrier wall 226 and out through exit opening 228 to unloading station 230 in a generally horizontal position for stacking in vertical stack 232.

In changing the orientation of the frame between horizontal and vertical, frame end 222 moves downwardly and upwardly along a swing arc 234, FIG. 22, transversely to the direction of transport through drip station 220. Frame end 224 is suspended and supported by cable 208 from the transport mechanism in both of the horizontal and vertical positions of the frame. Frame end 222 is suspended and supported from the transport mechanism in the horizontal position of the frame, but not in the vertical position of the frame. Cable 206 is tautly connected between conveyor 210 and frame end 222 when the frame is in its horizontal position. Cable 206 remains loosely connected between conveyor 210 and frame end 222 when the frame is in the vertical position. Frame end 222 swings about a pivot axis 236 parallel to the direction of transport through drip station 220. The downward swing of frame end 222 provides an adjustable drip angle according to the length to which cable 206 is varied. Cable 206 provides variable length attachment means having a short length suspending frame end 222 with the frame in a horizontal position, and having longer lengths allowing frame end 222 to swing downwardly along swing arc 234 to an adjustable drip angle. In the fully extended slack position of cable 206, frame 202 hangs substantially vertically, with frame end 224 suspended by cable 208 from conveyor 210, and with frame end 222 substantially vertically below frame end 224.

Conveyor 210 is provided by a bar 238, FIG. 23, spanning beams 240 and 242 and rolling therealong at rollers 244 and 246 as driven by motor 248 through drive belt 250. Bar 238 has a pair of winch pulleys 252 and 254 driven by respective motors 256 and 258, and having the above noted respective cables 206 and 208 depending downwardly therefrom and engaging frame 202.

It is recognized that various equivalents, alternatives and modifications are possible within the scope of the appended claims.

I claim:

1. A manufacturing method for applying a coating to vehicle structural components, comprising:

providing a loading station;

providing a transport mechanism;

providing a coating station having a coating liquid;

providing a drip station;

providing an unloading station;

attaching said vehicle structural component in a generally horizontal position to said transport mechanism at said loading station;

transporting said vehicle structural component in said generally horizontal position to said coating station;

transporting said vehicle structural component in said generally horizontal position through said coating station to said drip station;

changing the orientation of said vehicle structural component to a generally vertical position;

transporting said vehicle structural component in said generally vertical position through said drip station;

changing the orientation of said vehicle structural component to said generally horizontal position;

transporting said vehicle structural component in said generally horizontal position to said unloading station;

detaching said vehicle structural component in said generally horizontal position from said transport mechanism, wherein said vehicle structural component has a longitudinal extent of given length, and wherein said longitudinal extent extends generally horizontally when said vehicle structural component is in said generally horizontal position, and wherein said longitudinal extent extends generally vertically when said vehicle structural component is in said generally vertical position, said vehicle structural component having distally opposite longitudinal ends at the ends of said longitudinal extent, and comprising attaching said vehicle structural component in said generally horizontal position to said transport mechanism proximate each of said longitudinal ends, and changing the orientation of said vehicle structural component to said generally vertical position by releasing one of said longitudinal ends such that said one longitudinal end of said vehicle structural component swings downwardly such that said vehicle structural component hangs generally vertically from the other of said longitudinal ends attached to said transport mechanism.

2. The invention according to claim 1 comprising attaching said longitudinal ends of said vehicle structural component by a respective pair of cables to said transport mechanism, changing the orientation of said vehicle structural component from said generally horizontal position to said generally vertical position at said drip station by providing slack in one of said cables such that said one end of said vehicle structural component swings downwardly to a position generally vertically below the other end of said vehicle structural component.

3. The invention according to claim 2 comprising supporting said vehicle structural component in said generally vertical position substantially solely by the other of said cables when said one end of said vehicle structural component has swung downwardly to said position generally vertically below said other end of said vehicle structural component.

4. The invention according to claim 3 comprising leaving said one cable attached to said one longitudinal end of said vehicle structural component in said generally vertical position.

5. The invention according to claim 4 comprising changing the orientation of said vehicle structural component from said generally vertical position to said generally horizontal position at the end of said drip station by tensioning said one cable and pulling said one longitudinal end of said vehicle structural component upwardly such that said vehicle structural component is supported by both of said cables.

* * * * *